US005951076A

United States Patent [19]

Marco

[11] Patent Number: 5,951,076

[45] Date of Patent: Sep. 14, 1999

[54] ADHESIVE HANDLE FOR ENABLING HANDLING OF A CONTAINER, SUCH AS A BOTTLE

[75] Inventor: Leslie S. Marco, Bloomingdale, Ill.

[73] Assignee: Illinois Tool Works Inc., Glenview, Ill.

[21] Appl. No.: 09/014,476

[22] Filed: Jan. 28, 1998

[51] Int. Cl.[6] ..... B65D 23/10

[52] U.S. Cl. ..... 294/27.1; 220/752; 215/396

[58] Field of Search ..... 294/27.1, 31.2; 220/752, 757, 758; 229/117.08, 117.23, 117.24; 215/396

[56] References Cited

U.S. PATENT DOCUMENTS

| | | | |
|---|---|---|---|
| 2,617,676 | 11/1952 | Kinney | 220/758 |
| 2,775,382 | 10/1956 | Kayat | 229/117.23 |
| 3,258,288 | 6/1966 | Courter . | |
| 4,269,314 | 5/1981 | Barrash . | |
| 4,286,714 | 9/1981 | Zdarsky et al. . | |
| 4,396,128 | 8/1983 | Larson et al. . | |
| 4,412,624 | 11/1983 | Tanaka | 294/31.2 |
| 4,486,043 | 12/1984 | Rais | 294/27.1 |
| 4,498,620 | 2/1985 | Dickert et al. . | |
| 4,582,215 | 4/1986 | Barrash | 294/31.2 |
| 4,779,731 | 10/1988 | Fujio . | |
| 4,972,964 | 11/1990 | Escalante | 215/396 |
| 5,467,915 | 11/1995 | Mattson . | |
| 5,647,624 | 7/1997 | Beshara, Jr. . | |
| 5,695,232 | 12/1997 | Tipp | 215/396 |

*Primary Examiner*—Christopher P. Ellis
*Assistant Examiner*—Paul Chin
*Attorney, Agent, or Firm*—Trexler, Bushnell, Giangiorgi & Blackstone, Ltd.

[57] ABSTRACT

A one-piece plastic handle is adapted for attachment to a sidewall of a container, such as a bottle, to enable a consumer to easily lift and carry the container with one hand. The handle is formed from an elongated handle section having first and second arms which extend from opposite ends of the handle section to form generally an I-shape. When secured to a bottle, the underside of the arms are adhesively secured to the sidewall of the bottle in areas beyond the limits of a label applied to the sidewall of the bottle. A pair of opposed arcuate legs are formed along the length of the handle section between the first and second arms and define reverse bend struts. When the container is not being lifted, the handle section and the opposed arcuate legs lie flat against the sidewall of the container. When a load is placed on the handle section, the arcuate legs generally straighten and the reverse bend struts move toward each other to effectively increase the length of the handle section to permit a hand to be inserted between the handle section and the sidewall of the container so that the container can be easily lifted and carried. The opposed arcuate legs can be formed by a pair of arcuate cuts connected together by an elongated cut in the handle section. Alternatively, a cutout can form the opposed arcuate legs.

19 Claims, 2 Drawing Sheets

20
22
24
30
32
34
36
38
40
42
44
48
50
51
52
53
55
57
62
64
66
68
70
72
74
5

ADHESIVE HANDLE FOR ENABLING HANDLING OF A CONTAINER, SUCH AS A BOTTLE

BACKGROUND OF THE INVENTION

This invention is directed to a handle which is attached to a container, such as a bottle, to enable a consumer to easily lift and carry the container with one hand.

Some bottles, such as two-liter bottles, are difficult to grasp and carry with one hand because of their relatively large diameter. Handling the bottle with one hand by children or adults with smaller hands is especially difficult.

Several add-on handles have been suggested for consumer use. Such handles are disclosed in U.S. Pat. Nos. 5,647,624; 5,467,915; 4,779,731; 4,498,620; 4,396,128; 4,286,714; 4,269,314; and 3,258,288.

U.S. Pat. No. 5,647,624 discloses a handle which is adhesively secured to a bottle, such as two-liter bottle, and has a fold-out handle region formed from a flat rectangular device. U.S. Pat. No. 5,467,915 discloses a handle which is adhesively secured to a bottle and has a handle region which expands outwardly from the bottle to allow a consumer's hand to be placed thereunder.

U.S. Pat. No. 4,269,314 discloses a plastic handle which is adhesively secured to a bottle which relies on the inherent stretch of the plastic material to elevate the handle away from the bottle when a consumer places his or her hand thereunder. U.S. Pat. No. 3,258,288 discloses a handle which is secured to a bottle and has a hinge to permit a consumer to place his or her hand thereunder and to elongate the handle.

The remaining patents listed above disclose different techniques of adhesively securing a handle to a container.

OBJECTS AND SUMMARY OF THE INVENTION

A general object of the present invention is to provide a novel plastic handle which is secured to a container, such as a bottle, to enable a consumer to easily lift and carry the container with one hand.

An object of the present invention is to provide a novel one-piece, plastic handle which is adhesively secured to a container, such as a two-liter bottle, to enable a consumer to easily lift and carry the container.

Another object of the present invention is to provide a novel one-piece, plastic handle which, when not being used, lays flat against a container, and when being used, elevates to provide sufficient room for a consumer to place his or her hand thereunder.

Briefly, and in accordance with the foregoing, the present invention discloses a one-piece plastic handle which attaches to a sidewall of a container, such as a bottle, to enable a consumer to easily lift and carry the container with one hand. The handle is formed from an elongated handle section having first and second arms which extend from opposite ends of the handle section to form generally an I-shape. The underside of the arms are adhesively secured to the sidewall of the container in areas beyond the limits of a label applied to the sidewall of the container. A pair of opposed arcuate legs are formed along the length of the handle section between the first and second arms. The opposed arcuate legs define reverse bend struts. When the container is not being lifted, the handle section and the opposed arcuate legs lie flat against the sidewall of the container. When a load is placed on the handle section, the arcuate legs generally straighten and the reverse bend struts move toward each other to effectively increase the length of the handle section to permit a hand to be inserted between the handle section and the sidewall of the container so that the container can be easily lifted and carried. The opposed arcuate legs can be formed by a pair of arcuate cuts connected together by an elongated cut in the handle section. Alternatively, a cutout can form the opposed arcuate legs.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 2:
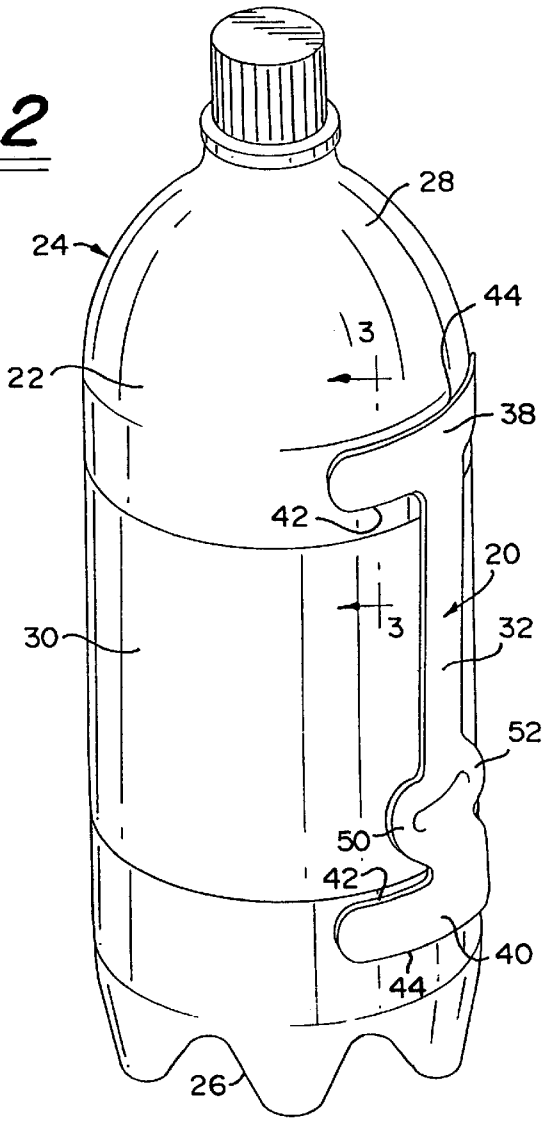
FIG. 2 is a perspective view of the handle of FIG. 1 attached to a bottle with the handle being at rest.
Figure 1:
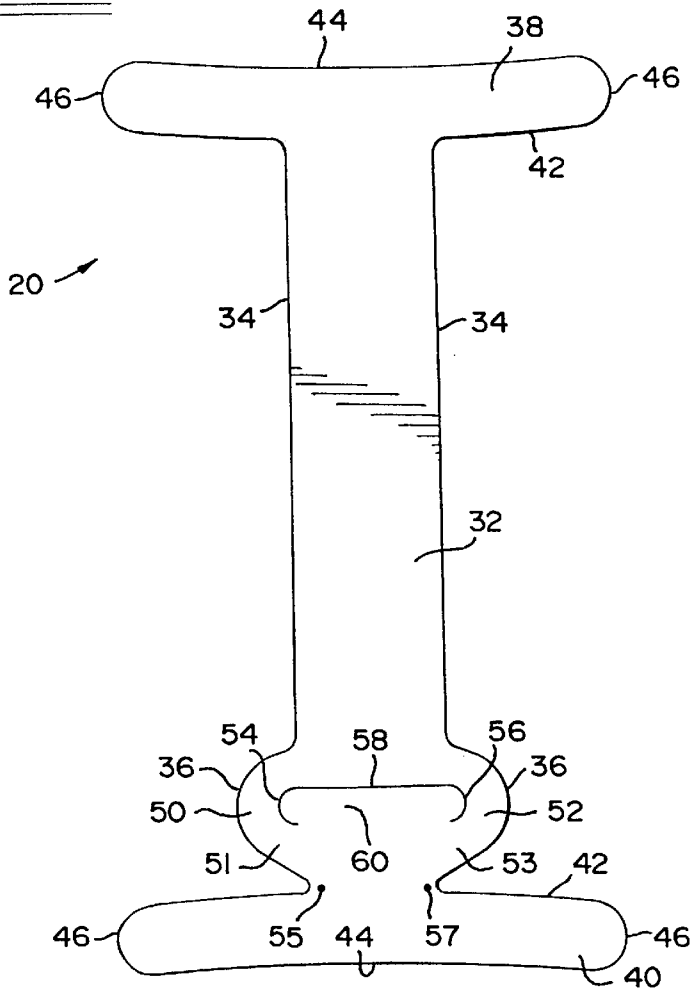
FIG. 1 is a top elevational view of a one-piece plastic handle which incorporates the features of a first embodiment of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The present invention presents a novel one-piece plastic handle 20 which is adapted for attachment to a curved portions of the sidewall 22 of a container 24, such as a bottle and, as shown in the drawings, a two-liter bottle. The plastic handle 20 is made of a tough, resilient and flexible plastic, such as polyethylene. When attached, the handle 20 allows a consumer to easily lift and carry the container 24 by placing his or her hand around the handle 20 and lifting. It is to be understood that the handle 20 of the present invention can be attached to a variety of containers. In the description herein, the container is referred to as a bottle 24 as shown in the drawings.

The bottle 24 used with the present invention is conventional and has a sidewall 22, a bottom wall 26 and a curved top wall 28 which has a spout formed at the end thereof. A label 30 may be applied to the sidewall 22 and may extend around the entire circumference or a portion thereof.

The handle 20 is generally formed in the shape of an "I" and has an elongated handle section 32 having first and second opposite ends. The elongated handle section 32 has opposed edges 34 along substantially all of the length thereof and opposed arcuate edges 36 along a portion of the length thereof for reasons described herein. Opposed edges 34 may be straight, substantially straight or curved to any form.

First and second attachment pads or arms 38, 40 extend from and are integrally formed with the respective first and second ends of the handle section 32. The first and second arms 38, 40 extend generally perpendicularly to the elongated handle section 32. Each of the first and second arms 38, 40 have a first edge 42 proximate to the handle section 32 and an opposed second edge 44 connected together by curved end edges 46. The first and second edges 42, 44 of each arm 38, 40 are slightly curved to provide a parallel securement when the handle 20 is mounted on the curved portions of the sidewall 22 of the bottle 24. If the sidewall of the bottle is cylindrical, the first and second edges 42, 44 of each arm 38, 40 can be straight to provide a parallel securement when the handle 20 is mounted thereon. To secure the handle 20 to the sidewall 22 of the bottle 24, adhesive 48 is provided on the undersides of each of the arms 38, 40 to adhesively secure the handle 20 to the sidewall 22 of the bottle 24, and preferably beyond the limits of the label 30 applied thereto so as to not cover any of the graphics displayed on the label 30.

A pair of opposed arcuate legs 50, 52 are formed at the point of the curved edges 36 of the handle section 32, which curved edges 36 are between the first and second arms 38, 40. As shown in FIGS. 1–5, the opposed arcuate legs 50, 52 are formed by a pair of arcuate cuts 54, 56 connected together by an elongated cut 58 in the handle section 32, such elongated cut 58 extending perpendicular to the axial length of the handle section 32. This forms a flap 60 in the handle section 32. The arcuate legs 50, 52 and the cuts 54, 56 respectively define a reverse angle strut 51, 53 on each leg 50, 52. As shown in the alternate embodiment in FIG. 6, the opposed arcuate legs 50, 52 are formed by a cutout 62 in the handle section 32 and the reverse angle struts 51, 53 are defined by the opposed arcuate legs 50, 52 and the cutout 62. The cutout 62 has opposed arcuate edges 64, 66 which are joined together by opposed straight edges 68, 70.

As shown in FIG. 2, when the bottle 24 is not being carried and thus no load is being applied to the handle section 32, the handle section 32 and the arcuate legs 50, 52 lay flat against the sidewall of the bottle 24.

Figures 3, 4, 5, 6:
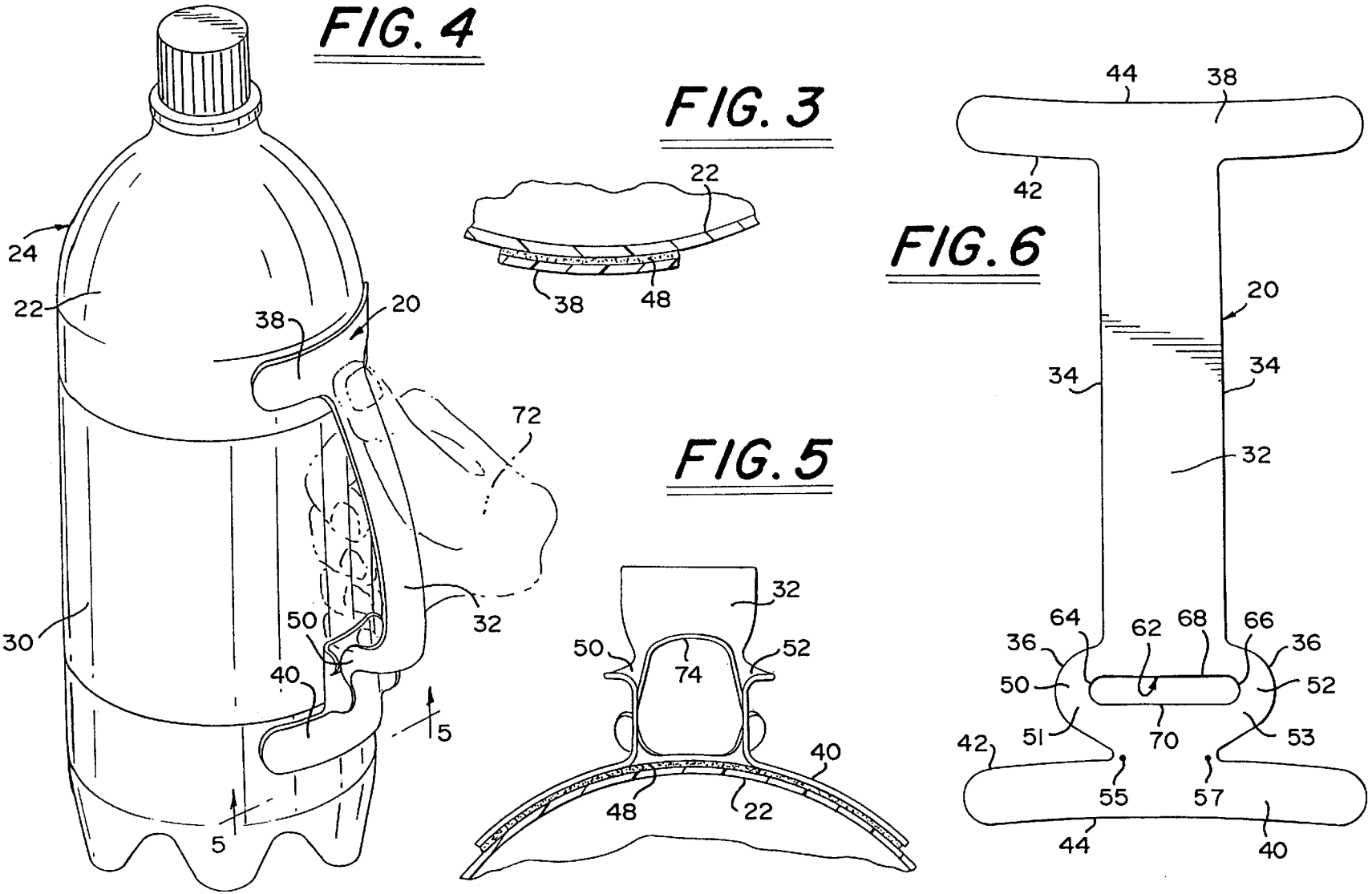
FIG. 3 is cross-sectional view along line 3—3 in FIG. 2.
FIG. 4 is a perspective view of the handle of FIG. 1 attached to a bottle with the handle being placed under a load so that a consumer can easily lift and carry the bottle.
FIG. 5 is a cross-sectional view along line 5—5 in FIG. 4.
FIG. 6 is a top elevational view of a one-piece plastic handle which incorporates the features of an alternate embodiment of the invention.

As shown in FIGS. 4 and 5, the opposed arcuate legs 50, 52 generally straighten to effectively increase the length of the handle section 32 when the handle section 32 is placed under a load, such as a consumer inserting his or her hand 72 between the handle section 32 and the sidewall of the bottle 24, to lift the handle section 32 of the handle 20 away from the sidewall 22 of the bottle 24 and to provide sufficient space for the consumer's hand to be inserted therebetween. In the embodiment shown in FIG. 1, the cuts 54, 56, 58 allow the legs 50, 52 to straighten and form an aperture 74 along the length of the handle section 32 when the legs 50, 52 straighten. The reverse angle struts 51, 53 toggle inward at points 55, 57 toward each other, thereby increasing the length of the handle 20. This reverse angle strut configuration also minimizes the peel forces at the first and second attachment pads or arms 38, 40. The formed aperture 74 elongates axially as the handle section 32 is being lifted away from the sidewall 22 of the bottle 24. The flap 60 buckles. When the consumer disengages his or her hand from the handle section 32, the legs 50, 52 reassume their arcuate shape and the handle section 32 flattens against the sidewall 22 of the bottle 24.

In the embodiment shown in FIG. 6, the cutout 62 allows the legs 50, 52 to straighten and elongates axially as the handle section 32 is being lifted away from the sidewall 22 of the bottle 24. The reverse angle struts 51, 53 toggle inward at points 55, 57 toward each other, thereby increasing the length of the handle 20. This reverse angle strut configuration also minimizes the peel forces at the first and second attachment pads or arms 38, 40. When the consumer disengages his or her hand from the handle section 32, the legs 50, 52 reassume their arcuate shape and the handle section 32 flattens against the sidewall 22 of the bottle 24.

The pair of arcuate legs 50, 52 are preferably formed along the length of the handle section 32 proximate to one of the arms 38, 40, shown as the second arm 40 in the drawings. This provides a sufficient length of the handle section 32 for a consumer to grasp without requiring the consumer to grasp the arcuate legs 50, 52. More than one pair of arcuate legs may be provided along the length of the handle section 32.

While preferred embodiments of the present invention are shown and described, it is envisioned that those skilled in the art may devise various modifications of the present invention without departing from the spirit and scope of the appended claims.

The invention claimed is:

1. A plastic handle adapted for attachment to a sidewall of a container comprising: a one-piece member including an elongated handle section having first and second ends, adhesive means at said first and second ends for securing said handle to the sidewall of the container, said handle section including a pair of opposed arcuate legs formed along the length thereof between said first and second ends which are adapted to generally straighten to effectively increase the length of the handle section when under a load to permit a hand to be inserted between the handle section and the sidewall of the container, said handle section and said arcuate legs being adapted for laying flat against the side wall of the container when no load is applied to the handle section, said opposed arcuate legs defining reverse bend struts, said reverse bend struts moving toward each other to increase the length of the handle section when under the load.

2. A plastic handle as defined in claim 1, wherein said opposed arcuate legs are formed by a pair of arcuate cuts connected together by an elongated cut in said handle section.

3. A plastic handle adapted for attachment to a sidewall of a container comprising: a one-piece member including an elongated handle section having first and second ends, adhesive means at said first and second ends for securing said handle to the sidewall of the container, said handle section including a pair of opposed arcuate legs formed by a cutout in said handle section along the length of said handle section between said first and second ends, said opposed arcuate legs being adapted to generally straighten to effectively increase the length of the handle section when under a load to permit a hand to be inserted between the handle section and the sidewall of the container, said handle section and said arcuate legs being adapted for laying flat against the side wall of the container when no load is applied to the handle section.

4. A plastic handle as defined in claim 1, wherein said adhesive means is disposed at an underside of each of said first and second ends of said handle section.

5. A plastic handle as defined in claim 1, wherein a first arm is integrally formed with and extends from said first end of said handle section, and a second arm is integrally formed with and extends from said second end of said handle section, said adhesive means being disposed on said first and second arms.

6. A plastic handle as defined in claim 5, wherein said container has a curved sidewall and each said first and second arms has a first edge proximate to said handle section and an opposed second edge, said first and second edges being curved.

7. A plastic handle as defined in claim 5, wherein said pair of arcuate legs are formed along the length of said handle section proximate to said second arm.

8. A plastic handle as defined in claim 5, wherein said adhesive means is disposed on an underside of each of said first and second arms.

9. A plastic handle adapted for attachment to a sidewall of a container comprising: a one-piece member including an elongated handle section having first and second ends, adhesive means at said first and second ends for securing said handle to the sidewall of the container, said handle section including a pair of opposed arcuate legs formed along the length thereof between said first and second ends which are adapted to generally straighten to effectively increase the length of the handle section when under a load to permit a hand to be inserted between the handle section and the sidewall of the container, said handle section and said arcuate legs being adapted for laying flat against the side wall of the container when no load is applied to the handle section, a first arm integrally formed with and extending from said first end of said handle section, and a second arm integrally formed with and extending from said second end of said handle section, said adhesive means being disposed on said first and second arms, said first and second arms and said handle section generally forming an I-shape.

10. A package comprising: a plastic handle and a container, said container comprising a sidewall and having a label on said sidewall, said plastic handle comprising a one-piece member including an elongated handle section having first and second ends, adhesive means at said first and second ends for securing said handle to said sidewall of said container and said ends of said handle section being adhesively secured to the sidewall of the container in areas beyond the limits of the label, said handle section including a pair of opposed arcuate legs formed along the length thereof between said first and second ends which are adapted to generally straighten to effectively increase the length of the handle section when under a load to permit a hand to be inserted between said handle section and said sidewall of said container, said handle section and said arcuate legs being adapted for laying flat against said side wall of said container when no load is applied to the handle section.

11. A package as defined in claim 10, wherein said opposed arcuate legs of said plastic handle define reverse bend struts, said reverse bend struts moving toward each other to increase the length of the handle section when under the load.

12. A package as defined in claim 10, wherein said opposed arcuate legs of said plastic handle are formed by a pair of arcuate cuts connected together by an elongated cut in said handle section.

13. A package as defined in claim 10, wherein said opposed arcuate legs of said plastic handle are formed by a cutout in said handle section.

14. A package as defined in claim 10, wherein said adhesive means is disposed at an underside of each of said first and second ends of said handle section of said plastic handle.

15. A package as defined in claim 10, wherein a first arm is integrally formed with and extends from said first end of said handle section of said plastic handle, and a second arm is integrally formed with and extends from said second end of said handle section of said plastic handle, said adhesive means being disposed on said first and second arms.

16. A package as defined in claim 15, wherein said sidewall of said container is curved and each said first and second arms has a first edge proximate to said handle section and an opposed second edge, said first and second edges being curved.

17. A package as defined in claim 15, wherein said pair of arcuate legs of said plastic handle are formed along the length of said handle section proximate to said second arm.

18. A package as defined in claim 15, wherein said adhesive means is disposed on an underside of each of said first and second arms of said plastic handle.

19. A package as defined in claim 15, wherein said first and second arms and said handle section of said plastic handle generally form an I-shape.

* * * * *